US005206626A

United States Patent [19]

Minasy et al.

[11] Patent Number: 5,206,626

[45] Date of Patent: Apr. 27, 1993

[54] STABILIZED ARTICLE SURVEILLANCE RESPONDER

[75] Inventors: Arthur J. Minasy, Woodbury, N.Y.; Samuel Sensiper, Los Angeles, Calif.; Scott H. Fisher, East Northport, N.Y.

[73] Assignee: Knogo Corporation, Hauppauge, N.Y.

[21] Appl. No.: 812,949

[22] Filed: Dec. 24, 1991

[51] Int. Cl.[5] ..... G08B 13/24

[52] U.S. Cl. ..... 340/572; 70/57.1; 340/693

[58] Field of Search ..... 340/572, 693; 70/57.1

[56] References Cited

U.S. PATENT DOCUMENTS

| | | | |
|---|---|---|---|
| 3,016,536 | 1/1962 | Fubini | 343/801 |
| 3,098,971 | 7/1963 | Richardson | 455/19 |
| 3,384,892 | 5/1968 | Postman | 342/42 |
| 3,518,546 | 6/1970 | Augenblick et al. | 455/19 |
| 3,713,162 | 1/1973 | Munson et al. | 343/705 |
| 3,718,922 | 2/1973 | Williams et al. | 340/572 |
| 3,895,368 | 7/1975 | Gordon et al. | 340/572 |
| 3,933,240 | 1/1976 | Humble | 206/1.5 |
| 4,063,229 | 12/1977 | Welsh et al. | 340/571 |
| 4,139,844 | 2/1979 | Reeder | 340/572 |
| 4,281,321 | 7/1981 | Narlow et al. | 340/572 |
| 4,302,846 | 11/1981 | Stephen et al. | 455/19 |
| 4,471,344 | 9/1984 | Williams | 340/572 |
| 4,565,996 | 1/1986 | Close | 340/572 |
| 4,642,640 | 2/1987 | Woolsey et al. | 342/42 |
| 4,700,179 | 10/1987 | Fancher | 340/572 |
| 4,751,500 | 6/1988 | Minasy et al. | 340/572 |
| 4,903,383 | 2/1990 | Gartshore | 340/572 |
| 5,099,228 | 3/1992 | Israel et al. | 340/693 |

OTHER PUBLICATIONS

Carver, et al., "Microstrip Antenna Technology" pp. 2-24, IEEE Trans. Antennas Propagat. vol. AP-29, No. 1, Jan. 1981.

*Primary Examiner*—Glen R. Swann, III

*Attorney, Agent, or Firm*—Fitzpatrick, Cella, Harper & Scinto

[57] ABSTRACT

An electronic article surveillance system responder which comprises an electrical responder circuit and a housing which mounts the circuit on an article to be protected. The housing is arranged to support the circuit in such a manner that a dielectric region is formed between the circuit and the article. An electrically conductive plate is also held by the housing on the opposite side of the dielectric region from the circuit to isolate the circuit from the effects of metal objects on which the responder is mounted. The housing is flared so that it can be mounted on an article in proper orientation.

24 Claims, 2 Drawing Sheets

FIG. 1
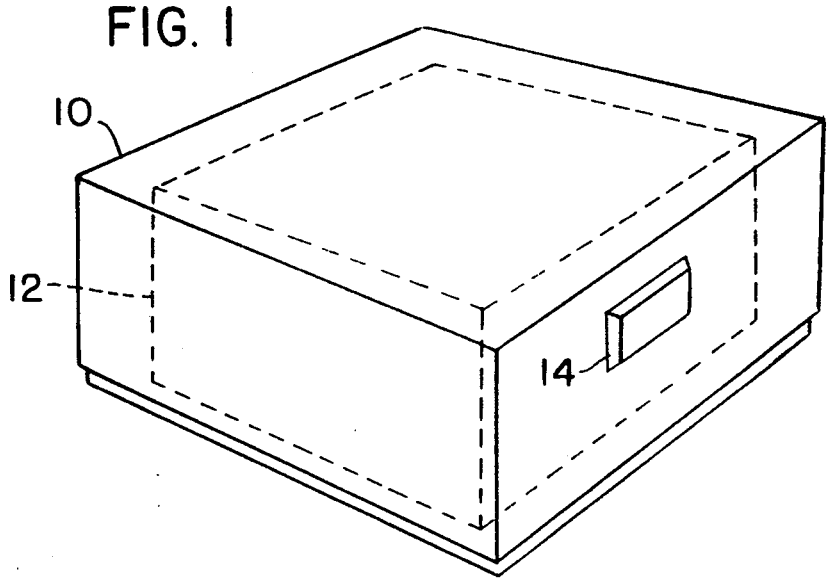
FIG. 2
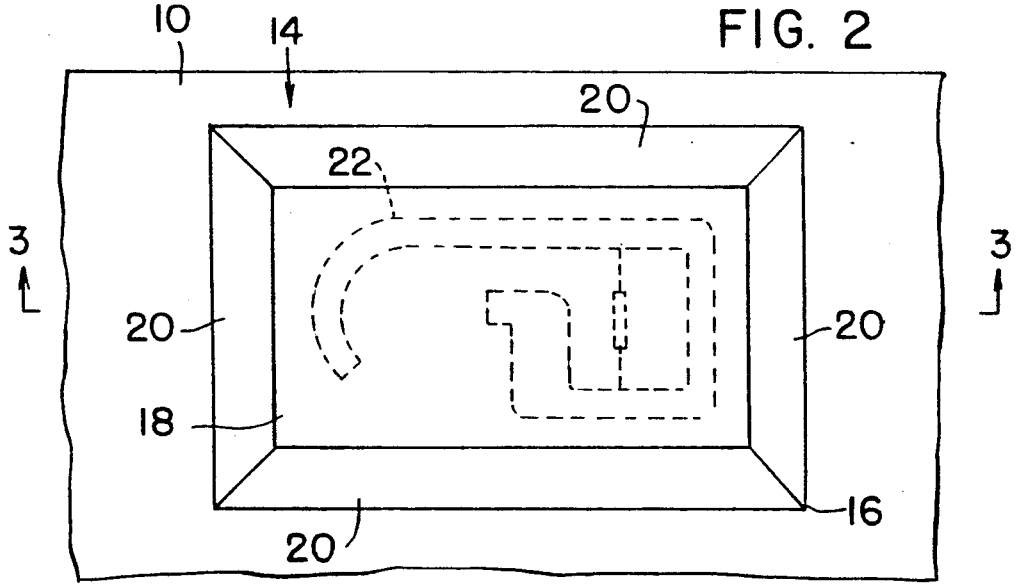
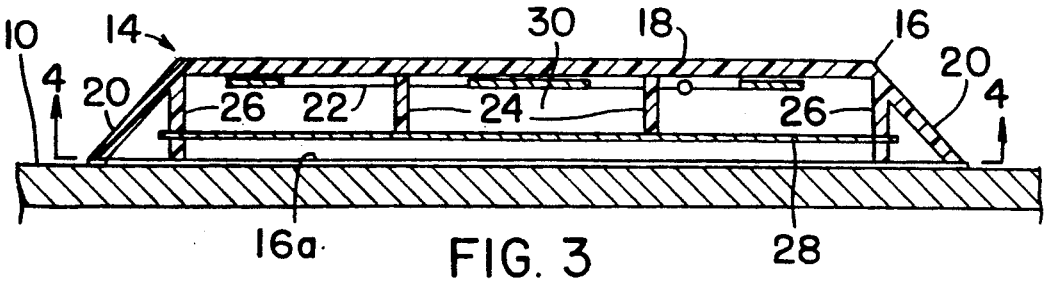
FIG. 3

STABILIZED ARTICLE SURVEILLANCE RESPONDER

BACKGROUND OF THE INVENTION

1. Field of the Invention

This invention relates to electronic article surveillance apparatus and more particularly it concerns novel surveillance responders having response characteristics which are substantially independent of the material of the object to which the responders are attached.

2. Description of the Prior Art

U.S. Pat. Nos. 4,700,179 and No. 4,471,344 disclose anti-theft article surveillance systems wherein an article to be protected against the unauthorized taking from a surveillance area has a transponder mounted thereon and wherein transmitter and receiver antennas are arranged at an exit from the area. The transmitter antenna generates electromagnetic interrogation waves at the exit; and if an article on which a transponder is mounted is carried through the exit, the transponder disturbs the interrogation waves in a predetermined manner, for example, by producing waves which are harmonics of the interrogation waves. The receiver antenna is connected to a receiver system which responds to the predetermined disturbances to produce an alarm.

The above mentioned patents describe interrogation waves whose frequency is in the range of 915 megahertz and transponder produced disturbances in the range of 1830 megahertz. Other electronic article surveillance systems operate at frequencies which are much lower; but an advantage of using these high frequencies is that the transponders mounted on the protected articles can be made quite small and the system can be used with wide exit passageways. A disadvantage of article surveillance systems which use high frequency waves has been that the presence of certain materials, such as metal, will interfere with the performance of the transponder. Therefore, systems using such high frequencies have not been suitable for protecting articles made of metal.

SUMMARY OF THE INVENTION

The present invention overcomes the above described problem of the prior art and provides a transponder (also called a "responder" or "target") for an electronic article surveillance system which is only minimally affected by the material of the article on which it is mounted. Thus the responder of the present invention may be used to protect both non-metallic articles, such as clothing, and metallic articles, such as appliances, from theft.

According to one aspect of the invention there is provided a novel responder for use in detecting the unauthorized movement of an article to which it is attached. This responder comprises an electric circuit lying in a flat plane and configured to respond to incident electromagnetic interrogation waves by producing predetermined detectable disturbances thereto. A support is provided for securing the circuit to an article to be protected. The support is constructed to provide between the circuit and the article, a dielectric region of sufficient thickness to make the circuit response substantially independent of the material of the article.

According to another aspect, the novel responder of the present invention additionally includes an electrically conductive plate. The support mounts the circuit over the plate and is constructed to provide between the circuit and plate, a dielectric region of sufficient thickness to prevent substantial degradation by the plate of the response of said circuit to said electromagnetic interrogation waves. The electrically conductive plate produces a preloading effect on the circuit which minimizes the effects of other metal objects in the vicinity of the responder; and the dielectric region prevents the electrically conductive plate and any other metal object from coming so close to the responder circuit as to interfere with its ability to respond to electromagnetic interrogation waves.

BRIEF DESCRIPTION OF THE DRAWINGS

FIG. 1 is a perspective view of an article of merchandise to which a novel responder according to the present invention is attached.

FIG. 2 is a fragmentary plan view of the a side of the article of FIG. 1 on which the responder is mounted;

FIG. 3 is a section view taken along line 3—3 of FIG. 2;

DETAILED DESCRIPTION OF THE PREFERRED EMBODIMENT

Figure 4:
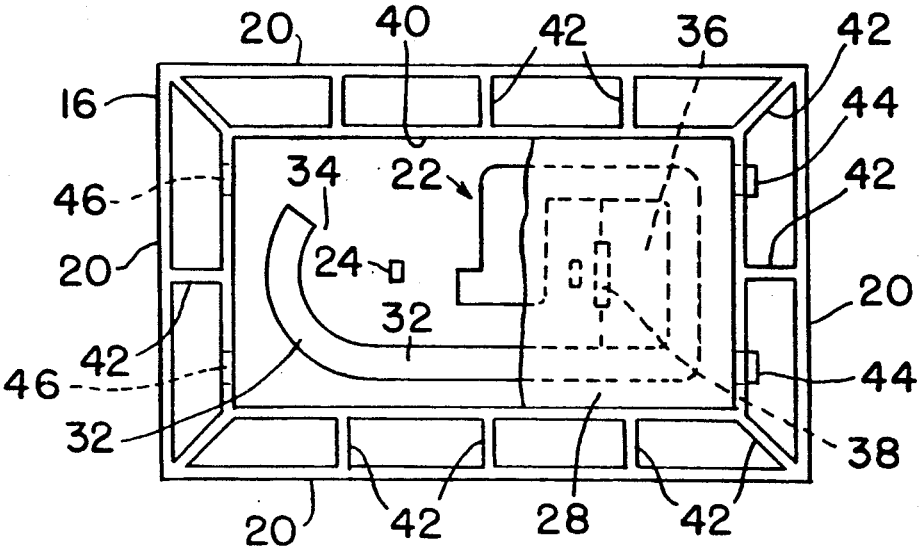
FIG. 4 is a bottom view of the responder taken along line 4—4 of FIG. 3.

In FIG. 1 there is shown a container 10, such as a box, in which an article of merchandise 12 (shown in dashed outline) is contained. On one side of the container 10 a responder 14 according to the present invention is affixed, for example, by glue. If desired, the responder 14 may be affixed to an inside container or to the article of merchandise itself. In these latter cases the outside container must be non-metallic or at least transparent to the electromagnetic waves at the operating frequencies of the responder.

Turning now to FIG. 2, it will be seen that the responder 14 comprises a housing 16 in the form of a truncated pyramid with a flat rectangular upper wall 18 and slanted side walls 20 which flare out from the upper wall. The lower edges of the side walls 20 lie in a flat plane parallel to and spaced from the plane of the top wall 18. The housing 16 encloses a responder circuit 22 shown in dashed outline in FIG. 2 and serves as a support for securing the circuit 22 to the container 10.

The housing 16 is hollow and is molded of plastic material, for example, such as high impact polystyrene. As shown in FIG. 3, the circuit 22 lies in a flat plane and is secured to the underside of the upper wall 18 of the housing. Any suitable type of adhesive may be used to secure the circuit 22 to the wall 18. The housing 16 is also formed with internal abutments 24 and end ribs 26 which extend down from the underside of the upper wall 18. The end ribs 26 extend down to the plane of the lower edge of the housing side walls 20. The abutments 24, however, terminate short of that plane. A thin plate 28 of electrically conductive material is mounted inside the housing 16 so that it rests against the abutments 24 and is held in place by the end ribs 26. The plate is preferably of a resilient metal so that it can be snapped into place. The plate may be of spring brass or steel, for example 1095 spring steel. In the latter case the plate 28 may be coated with a high conductivity material such as copper. It will be appreciated that the housing 16 thus serves as a support which mounts the circuit 22 over the plate 28 and forms between them and between the circuit 22 and the article 10 or 12, a dielectric region 30. The thickness of this dielectric region is sufficient to prevent the plate 28 from substantially degrading the response of the circuit 22 to electromagnetic interrogation waves. In order to minimize electrical interference from the abutments 24, it is preferred that they have a permittivity as close as possible to that of the material which makes up the dielectric region 30 and that they be as narrow as possible.

The housing 16 is affixed to the surface of the container 10 by an epoxy glue or equivalent adhesive applied around the lower edge of the side walls 20.

Figure 5:
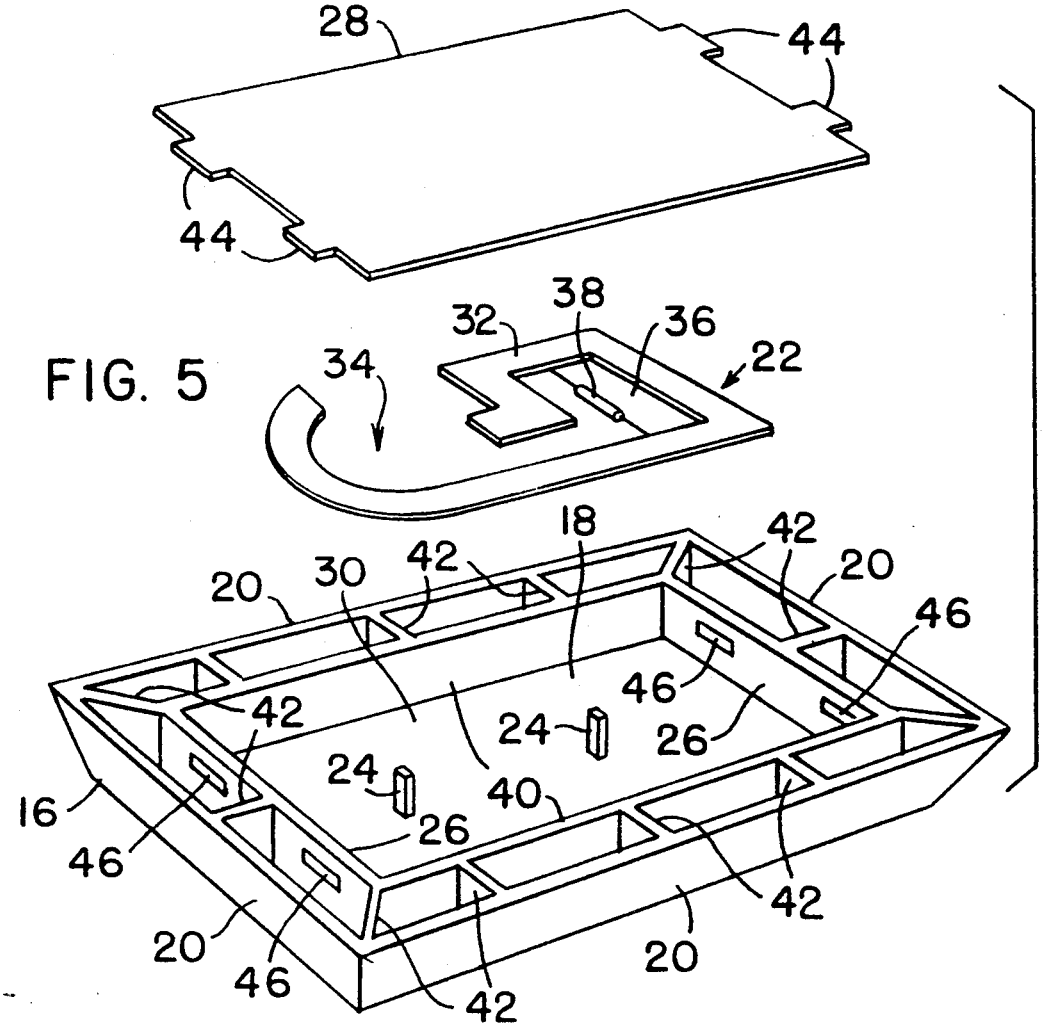
FIG. 5 is an exploded perspective view showing the construction of the responder of FIGS. 1–4.

As shown in FIGS. 4 and 5, the circuit 22 comprises a stamping 32 of a highly conductive material such as sheet copper. The stamping 32 forms partial loops 34 and 36 at opposite ends with the loop 36 being more nearly closed than the loop 34. A diode 38 is connected across the loop 36. The entire circuit 22, which lies in a flat plane, is glued to the underside of the upper housing wall 18 and lies within the end ribs 26 and side ribs 40 which also extend down from the side edges of the upper wall. The end and side ribs 26 and 40 are further supported by bracing ribs 42 which extend between these ribs and the side walls 20 of the housing 16.

The electrically conductive plate 28 is formed with tongues 44 at each end and these tongues fit into slots 46 in the end ribs 26 of the housing 16. This arrangement permits the plate 28 to be fitted into place simply by flexing it to bring the tongues between the end ribs 26 and then allowing the plate to flatten so that the tongues extend into the slots 46. The abutments 24 serve to support the plate 28 in its intermediate region.

In use, the responder 14 is attached to an article to be protected, such as the container 10 or an object 12 within the container, by gluing the responder around the lower edges of the slanted sidewalls 20, to hold them against the surface of the article. The circuit 22 responds to interrogation waves of a particular frequency, e.g. 915 megahertz, which are generated near an exit passageway by a transmitter (not shown) and disturbs those waves by producing response waves at a harmonic frequency, e.g. 1830 megahertz. A receiver at the exit (also not shown) is arranged to produce an alarm in response to the occurrence of electromagnetic waves at 1830 megahertz. The manner in which the circuit 22 responds to and disturbs the interrogation waves is well known and does not itself form this invention. Also, the particular frequencies mentioned, e.g. 915 and 1830 megahertz are not critical to this invention and other frequencies may be used.

As mentioned, the responder of the present invention is less affected by the material of the article to which it is attached than are prior art responders. The isolation from the effects of the article material is achieved in two ways. First, by providing the dielectric region 30 between the responder circuit 22 and the article 10 or 12, the article, even if it is made of metal, can affect the response of the circuit 22 only to a limited amount. It can be appreciated from this that if the dielectric region 30 were made very thick, the effect of the article 10 or 12 could be made even smaller. However, a very thick dielectric region 30 would make the responder too big and impractical to use. The thickness of the region 30 could be reduced if the permittivity of the dielectric material in the region 30 were significantly higher than air. However, when the region 30 is air, a thickness between 0.160 and 0.200 inches (4.06 and 5.08 mm) serves to reduce the effects of a metal article sufficiently to enable the responder to be detected with a high degree of reliability. The best compromise between responder thickness and isolation from the effects of a metal article is believed to be with a dielectric region thickness of about 0.190 inches (4.83 mm) where the dielectric region 30 is air or has a permittivity substantially the same as air.

In the illustrated embodiment, the dielectric region 30 is air. However other dielectric materials may be used, for example foamed polystyrene. If a solid material is used, such as foamed polystyrene, the abutments 24 and the end ribs 26 may be eliminated. Also, if a dielectric material is used in the dielectric region 30 with a permittivity greater than that of air, the overall size of the responder could be reduced.

The second way in which the responder of the present invention achieves isolation from the effects of the material of the article 10 or 12 to which the responder is attached is by the action of the electrically conductive plate 28. The circuit 22 is separated from the plate 28 by an amount equal to the thickness of the dielectric region 30. This separation limits the amount by which the plate 28 can affect the response of the circuit 22 in the same way that the separation of the circuit 22 from the article 10 or 12, as described above, limits the amount by which the article itself can affect the response of the circuit 22. The plate 28, however, does impose some preload on the circuit 22 and reduces its response to something less than it would have had no electrically conductive plate been present. Nevertheless, the presence of the plate 28 is of benefit because by preloading the circuit 22, the circuit is made to be less affected by the material of the article 10 or 12 on which it is mounted. Consequently, the performance of the circuit 22 is substantially the same whether the responder is attached to a metal article or to a non-metal article. This is advantageous because it enables the sensitivity of the detection system to be set to precise limits so that it will not produce false alarms by the occurrence of electromagnetic wave energy at 1830 megahertz unless the amplitude of that energy is within selected limits. This helps to avoid false alarms from materials that produce weak responses as well as from extraneous sources that produce very high bursts of high frequency energy. The thickness of the plate 28 is not critical, however, from the standpoint of convenience in mechanical handling, it is preferred that the plate have a thickness of about 0.010 inches (0.25 mm). On the other hand, the electrical conductivity and lateral extent of the plate 28 are important. It is preferred that the plate 28 have a surface electrical resistance no greater than 10 milliohms per square. Also, the plate 28 should have a lateral extent at least as great as the lateral extent of the circuit 22 and preferably should extend beyond the lateral edges of the circuit by about 0.062 inches (1.59 mm). A smaller lateral extent of the plate diminishes its effectiveness in isolating the circuit 22 from the effects of metal articles to which the responder may be attached. On the other hand, only insignificant increases in isolation occur when the plate 28 extends more than the preferred distance beyond the circuit 22.

The external shape of the responder housing 16, with upwardly and inwardly sloping walls provides a special advantage in that it ensures against mounting the responder on an article in an inverted position, namely, with the responder circuit 22 against the article 12 and the electrically conductive plate 28 covering the circuit 22. With such inverted mounting the responder would be rendered significantly, if not completely, non-responsive to electromagnetic interrogation waves. The trapezoidal or pyramidal shape provided by the sloped walls of the housing 16 make it easy to ascertain whether the circuit 22 is above the electrically conductive plate 28 or vice versa. In addition, even for a person who may not understand the significance of the internal construction of the responder, the trapezoidal or pyramidal shape of the housing 16 is such that one naturally would mount it with its larger surface against the article 12. Thus the shape of the housing provides a substantially foolproof way of ensuring that the responder is properly oriented when it is mounted on an article to be protected. It is preferred to have the side walls 20 extend at an angle of about 45 degrees relative to the top wall 18. However, this angle may vary somewhat.

The sloped sidewalls of the responder housing provide an added advantage in that they reduce the shearing force on the adhesive between the responder and the article to which it is attached when the responder is hit from the side. This helps to protect against unauthorized removal of the responder from the article it is intended to protect.

It is possible with this shape housing to provide a decorative coating, such as a company logo, or even a bar code on its outer surface. This will have the effect of disguising the nature of the device and at the same time will further help in ensuring that the housing is properly oriented when placed on the merchandise or package to be protected.

The housing may also be provided with a bottom sheet **16*a* (FIG. 3) which extends across the lower edges of the side walls 20** and conceals the internal structure of the device. The bottom sheet will also provide a greater surface area for attaching the device to an article or package to be protected. The bottom sheet may also be provided with markings on its surface facing inside the responder device. If the responder device is thereafter removed from the article or package, the bottom sheet will separate from the responder and remain on the package with the markings showing to indicate that a responder device had been removed from the article or package.

It should also be understood that the responder device can be attached to an article or package by means other than glue. For example, depending on the nature of the article or package, the responder device could be attached by machine screws.

It is also possible with this invention to provide within the housing a dye or other substance that will be released upon removal of the responder device from the article or container and which, upon release, will be readily recognize.

We claim:

1. A responder for use in detecting the unauthorized movement of an article to which it is attached, said responder comprising an electric circuit lying in a flat plane and configured to respond to incident electromagnetic interrogation waves by producing predetermined detectable disturbances thereto, and a support for securing said circuit to an article, said support being constructed to provide between said circuit and said article, a dielectric region of sufficient thickness to make the circuit response substantially independent of the material of the article.

2. A responder according to claim 1, wherein said dielectric region is air.

3. A responder according to claim 1, wherein said support is a housing which contains said electric circuit.

4. A responder according to claim 3, wherein said housing has a top wall and side walls extending down from the edges of the top wall to form said dielectric region, the lower edges of said sidewalls forming a plane parallel to the plane of the top wall.

5. A responder according to claim 4, wherein said circuit is affixed to the underside of said top wall.

6. A responder according to claim 5, wherein said side walls are affixed along their lower edge to the surface of an article to be protected.

7. A responder according to claim 6, wherein said side walls flare outwardly as they extend down from said top wall.

8. A responder according to claim 7, wherein said side walls flare at an angle of about 45 degrees relative to the top wall.

9. A responder according to claim 1, wherein said dielectric region has a thickness in the range of 0.160 and 0.200 inches (4.06 and 5.08 mm).

10. A responder according to claim 1, wherein said dielectric region has a thickness of 0.190 inches (4.82 mm).

11. A responder according to claim 10, wherein said circuit operates in the range of about 915 and 1830 megahertz.

12. A responder for use in detecting the unauthorized movement of an article to which it is attached, said responder comprising an electric circuit lying in a flat plane and configured to respond to incident electromagnetic interrogation waves by producing predetermined detectable disturbances thereto, an electrically conductive plate, a support which mounts said circuit over said plate, said support being constructed to provide between said circuit and said plate, a dielectric region of sufficient thickness to prevent substantial degradation by said plate of the response of said circuit to said electromagnetic interrogation waves.

13. A responder according to claim 12, wherein said dielectric region is air.

14. A responder according to claim 12, wherein said support is a housing which contains said electric circuit.

15. A responder according to claim 14 wherein said housing has a top wall and side walls extending down from the edges of the top wall to form said dielectric region, the lower edges of said sidewalls forming a plane parallel to the plane of the top wall.

16. A responder according to claim 15, wherein said circuit is affixed to the underside of said top wall.

17. A responder according to claim 16, wherein said side walls are affixed along their lower edge to the surface of an article to be protected.

18. A responder according to claim 17, wherein said side walls flare outwardly as they extend down from said top wall.

19. A responder according to claim 18, wherein said side walls flare at an angle of about 45 degrees relative to the top wall.

20. A responder according to claim 15, wherein a bottom sheet extends across the lower edges of the sidewalls and is separable from the housing when the housing is removed from the article.

21. A responder according to claim 20, wherein said bottom sheet has markings on the surface thereof which faces inside the housing.

22. A responder according to claim 12, wherein said dielectric region has a thickness in the range of 0.160 and 0.200 inches (4.06 and 5.08 mm).

23. A responder according to claim 12, wherein said dielectric region has a thickness of 0.190 inches (4.82 mm).

24. A responder according to claim 23, wherein said circuit operates in the range of about 915 and 1830 megahertz.

* * * * *